US010753194B2

(12) United States Patent
Dawson et al.

(10) Patent No.: US 10,753,194 B2
(45) **Date of Patent: *Aug. 25, 2020**

(54) DETERMINING DIVERTER EFFECTIVENESS IN A FRACTURE WELLBORE

(71) Applicant: Reveal Energy Services, Inc., Houston, TX (US)

(72) Inventors: Matthew A. Dawson, Sugerland, TX (US); Günther Kampfer, Trondheim (NO); Lukas Mosser, London (GB)

(73) Assignee: Reveal Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/538,164

(22) Filed: Aug. 12, 2019

(65) Prior Publication Data

US 2019/0360325 A1 Nov. 28, 2019

Related U.S. Application Data

(63) Continuation of application No. 15/192,218, filed on Jun. 24, 2016, now Pat. No. 10,378,333.

(51) Int. Cl.

| | |
|---|---|
| ***E21B 43/26*** | (2006.01) |
| ***E21B 47/06*** | (2012.01) |
| ***E21B 7/06*** | (2006.01) |

(52) U.S. Cl.

CPC ..... *E21B 47/06* (2013.01); *E21B 7/06* (2013.01); *E21B 43/26* (2013.01); *E21B 43/261* (2013.01)

(58) Field of Classification Search

CPC ..... E21B 43/26; E21B 47/06

See application file for complete search history.

(56) References Cited

U.S. PATENT DOCUMENTS

| | | | |
|---|---|---|---|
| 5,431,227 | A | 7/1995 | Montgomery et al. |
| 9,988,895 | B2 | 6/2018 | Roussel et al. |
| 10,378,333 | B2 | 8/2019 | Dawson et al. |
| 2009/0145660 | A1 | 6/2009 | Johnson et al. |
| 2010/0004906 | A1 | 1/2010 | Searles et al. |
| 2015/0075777 | A1 | 3/2015 | Walters et al. |
| 2015/0075779 | A1 | 3/2015 | Walters et al. |
| 2016/0177693 | A1 | 6/2016 | Gomaa et al. |
| 2016/0333680 | A1 | 11/2016 | Richter et al. |
| 2017/0002652 | A1 | 1/2017 | Kampfer et al. |

(Continued)

OTHER PUBLICATIONS

International Search Report and Written Opinion for Application No. PCT/US2017/039105 dated Sep. 6, 2017.

*Primary Examiner* — Kipp C Wallace
(74) *Attorney, Agent, or Firm* — Fish & Richardson P.C.

(57) ABSTRACT

Systems and methods for using pressure signals to assess effectiveness of a diverter in a stimulation wellbore are disclosed. A pressure signal in an observation wellbore in the subsurface formation may be assessed using a pressure sensor in direct fluid communication with a fluid in the observation wellbore. The fluid in the observation wellbore may be indirect fluid communication with a fracture emanating from the observation wellbore. The pressure signal may include a pressure change that is induced by a fracture being formed from a stimulation wellbore in the subsurface formation. The pressure signal may be a pressure-induced poromechanic signal. The slope in the pressure signal before and after the diverter are provided into the stimulation wellbore may be assessed to determine the effectiveness of the diverter.

20 Claims, 9 Drawing Sheets

(56) References Cited

U.S. PATENT DOCUMENTS

| | | | |
|---|---|---|---|
| 2017/0122077 | A1 | 5/2017 | Shahri et al. |
| 2017/0247995 | A1 | 8/2017 | Crews et al. |
| 2017/0370208 | A1 | 12/2017 | Dawson |

DETERMINING DIVERTER EFFECTIVENESS IN A FRACTURE WELLBORE

CROSS-REFERENCE TO RELATED APPLICATION

This application is a continuation of, and claims priority under 35 U.S.C. § 120 to, U.S. patent application Ser. No. 15/192,218, filed on Jun. 24, 2016, the entire contents of which are incorporated by reference herein.

TECHNICAL FIELD

Embodiments described herein relate to systems and methods for subsurface wellbore completion and subsurface reservoir technology. More particularly, embodiments described herein relate to systems and methods for assessing diverter effectiveness in fracture wellbores in sub surface hydrocarbon-bearing formations.

DESCRIPTION OF RELATED ART

Ultra-tight hydrocarbon-bearing formations (e.g., hydrocarbon-bearing resources) may have very low permeability compared to conventional resources. For example, the Bakken formation may be an ultra-tight hydrocarbon-bearing formation. These ultra-tight hydrocarbon-bearing formations are often stimulated using hydraulic fracturing techniques to enhance oil production. Long (or ultra-long) horizontal wells may be used to enhance production from these resources and provide production suitable for commercial production. However, even with these technological enhancements, these resources can be economically marginal and often only recover 5-15% of the original oil-in-place under primary depletion. Therefore, optimizing the development of this resource and the technology applied to this resources critical.

Diverters are used to divert the flow of well treatment fluids (e.g., injection fluids) from perforations taking more fluid to perforations taking less fluid. Diverters may be used to temporarily block off runaway fractures or low stress zones in a stage, which more readily propagate hydraulic fractures, forcing fracturing fluid and sand into new fractures. There are many types of commercial diverters including diverters that block perforations in the wellbore itself (sometimes known as wellbore diversion or near wellbore diversion) and diverters that pass through the well into the fractures where they block propagation in the hydraulic fractures themselves (sometimes known as deep diversion). Diverters, however, may be unreliable due to uncertainty in whether a diverter is going to work or not. For example, many fractures may be open in the wellbore and this can result in a great deal of uncertainty in where the diverter is going and what effect the diverter is going to have in the wellbore to mitigate the growth of the largest fracture, in some cases.

FIG. 1 depicts an example plot of diverter effectiveness for a series of diverter drops. As shown in FIG. 1, diverters only work fraction of the time (e.g., impedes or stops by the diverter). More than half the time, diverters may accelerate the growth of the largest fracture or has no impact on the largest fracture. Thus, being able to identify if a diverter works to stop or impede growth of the largest fracture is important due to the less 50% chance the diverter will work.

One method that has been used to attempt to assess the effectiveness of diverters is a Delta P measurement. FIG. 2 depicts an example of a plot of Delta P versus diverter event counts. As shown in FIG. 2, there does not appear to be any correlation between Delta P and the effectiveness of the diverter on the growth of the largest fracture (either stops, impedes, no impact, or accelerates). Thus, there is a need to be able to affectively assess if the diverter is effectively plugging existing perforations. More effective assessment of the diverter may be used to improve the use of diverters.

SUMMARY

In certain embodiments, a method for assessing a diverter in a fracture wellbore used in treating a subsurface formation includes forming a first fracture emanating from a first interval in a first wellbore in the subsurface formation. The first fracture may be in direct fluid communication with a first fluid in the first wellbore in the subsurface formation. A first pressure signal in a second wellbore may be assessed using a pressure sensor in direct fluid communication with second fluid in the second wellbore. The second fluid in the second wellbore may be in direct fluid communication with a second fracture in the subsurface formation emanating from a selected interval in the second wellbore. The first pressure signal assessed in the second wellbore may include a pressure change induced by a first applied net pressure in the first fracture. A first slope may be assessed in the first pressure signal. At least one diverter may be provided into the first interval in the first wellbore. A second slope in the first pressure signal may be assessed after providing the at least one diverter into the first wellbore to determine an effectiveness of the at least one diverter in inhibiting growth of the first fracture. The at least one diverter may be determined as being effective in inhibiting growth of the first fracture when the second slope in the first pressure signal is less than the first slope in the first pressure signal.

In some embodiments, the method for assessing a diverter in a fracture wellbore used in treating a subsurface formation includes identifying a first pressure-induced poromechanic signal in the first pressure signal. The first pressure-induced poromechanic signal may include one or more selected criteria in the first pressure signal that differentiate the first pressure-induced poromechanic signal from a direct pressure signal induced by direct fluid communication between the first wellbore and the second wellbore.

In certain embodiments, a system for assessing one or more geometric parameters of fractures in a subsurface formation includes first wellbore in the subsurface formation and a second wellbore in the subsurface formation. A first fracture may be configured to be formed from a first interval in the first wellbore and in direct fluid communication with a first fluid in the first wellbore. At least a second fracture may emanate from a selected interval in the second wellbore. The second fracture may be in direct fluid communication with a second fluid in the second wellbore. A pressure sensor may be in direct fluid communication with the second fluid in the second wellbore. At least one diverter may be configured to be provided into the first interval in the first wellbore at a selected time. A computer processor coupled to the pressure sensor may be configured to assess a first pressure signal from the pressure sensor while the first fracture is being formed. The first pressure signal may be induced by a first applied pressure in the first fracture. The computer processor may be configured to: assess first slope in the first pressure signal and assess a second slope in the first pressure signal after the at least one diverter is provided into the first wellbore at the selected time. The second slope may be used to determine an effectiveness of the at least one diverter in inhibiting growth of the first fracture. The at least one diverter may be determined as being effective in inhibiting growth of the first fracture when the second slope in the first pressure signal is less than the first slope in the first pressure signal.

In certain embodiments, a non-transient computer-readable medium including instructions that, when executed by one or more processors, causes the one or more processors to perform a method that includes one or more of the methods described above.

BRIEF DESCRIPTION OF THE DRAWINGS

Features and advantages of the methods and apparatus of the embodiments described in this disclosure will be more fully appreciated by reference to the following detailed description of presently preferred but nonetheless illustrative embodiments in accordance with the embodiments described in this disclosure when taken in conjunction with the accompanying drawings in which.

Figure 1:
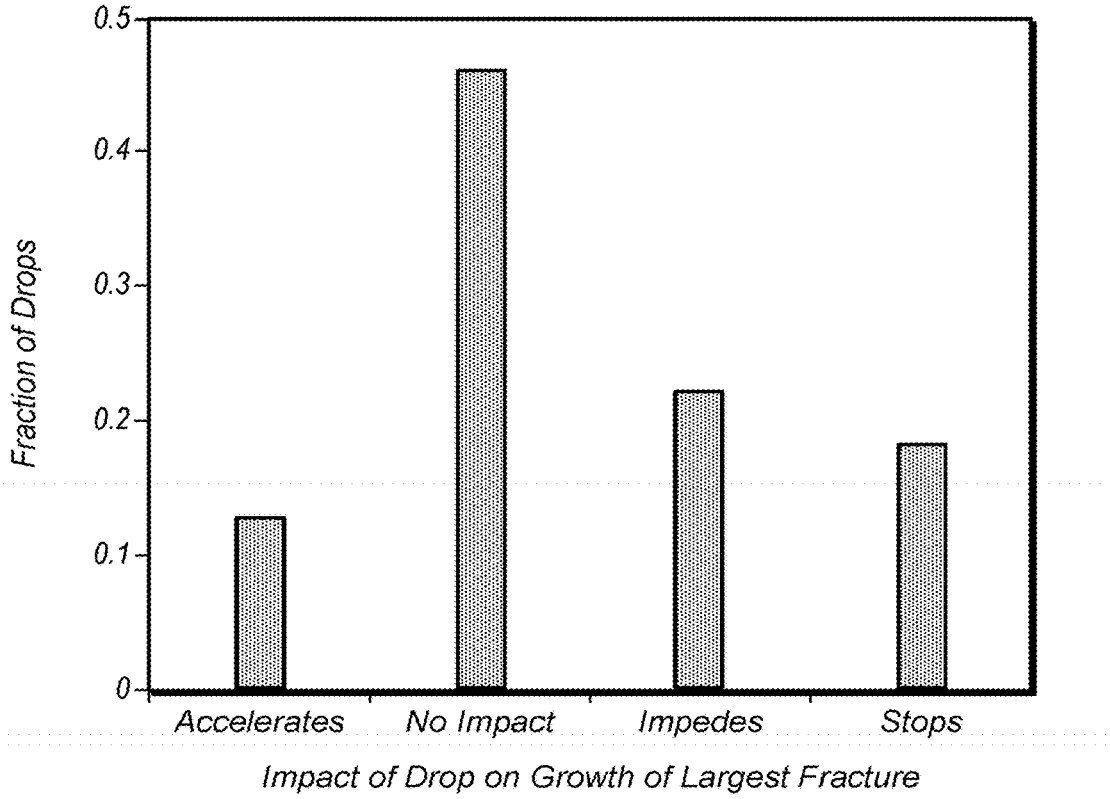
FIG. 1 depicts an example plot of diverter effectiveness for a series of diverter drops.
Figure 2:
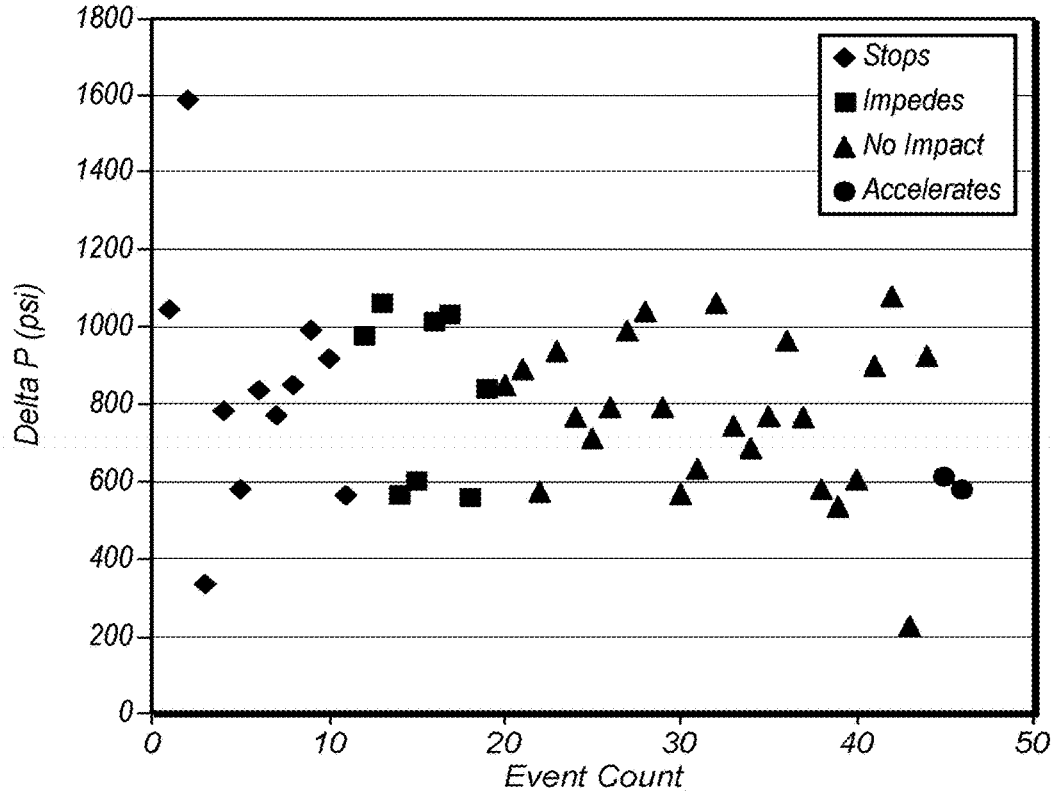
FIG. 2 depicts an example of a plot of Delta P versus diverter event counts.

While embodiments described in this disclosure may be susceptible to various modifications and alternative forms, specific embodiments thereof are shown by way of example in the drawings and will herein be described in detail. It should be understood, however, that the drawings and detailed description thereto are not intended to limit the embodiments to the particular form disclosed, but on the contrary, the intention is to cover all modifications, equivalents and alternatives falling within the spirit and scope of the appended claims. The headings used herein are for organizational purposes only and are not meant to be used to limit the scope of the description. As used throughout this application, the word "may" is used in a permissive sense (i.e., meaning having the potential to), rather than the mandatory sense (i.e., meaning must). Similarly, the words "include," "including," and "includes" mean including, but not limited to.

Various units, circuits, or other components may be described as "configured to" perform a task or tasks. In such contexts, "configured to" is a broad recitation of structure generally meaning "having circuitry that" performs the task or tasks during operation. As such, the unit/circuit/component can be configured to perform the task even when the unit/circuit/component is not currently on. In general, the circuitry that forms the structure corresponding to "configured to" may include hardware circuits and/or memory storing program instructions executable to implement the operation. The memory can include volatile memory such as static or dynamic random access memory and/or nonvolatile memory such as optical or magnetic disk storage, flash memory, programmable read-only memories, etc. The hardware circuits may include any combination of combinatorial logic circuitry, clocked storage devices such as flops, registers, latches, etc., finite state machines, memory such as static random access memory or embedded dynamic random access memory, custom designed circuitry, programmable logic arrays, etc. Similarly, various units/circuits/components may be described as performing a task or tasks, for convenience in the description. Such descriptions should be interpreted as including the phrase "configured to." Reciting a unit/circuit/component that is configured to perform one or more tasks is expressly intended not to invoke 35 U.S.C. § 112(f) interpretation for that unit/circuit/component.

The scope of the present disclosure includes any feature or combination of features disclosed herein (either explicitly or implicitly), or any generalization thereof, whether or not it mitigates any or all of the problems addressed herein. Accordingly, new claims maybe formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

DETAILED DESCRIPTION

This specification includes references to "one embodiment" or "an embodiment." The appearances of the phrases "in one embodiment" or "in an embodiment" do not necessarily refer to the same embodiment, although embodiments that include any combination of the features are generally contemplated, unless expressly disclaimed herein. Particular features, structures, or characteristics may be combined in any suitable manner consistent with this disclosure.

Fractures in subsurface formations as described herein are directed to fractures created hydraulically. It is to be understood, however, that fractures created by other means (such as thermally or mechanically) may also be treated using the embodiments described herein.

Figure 3:
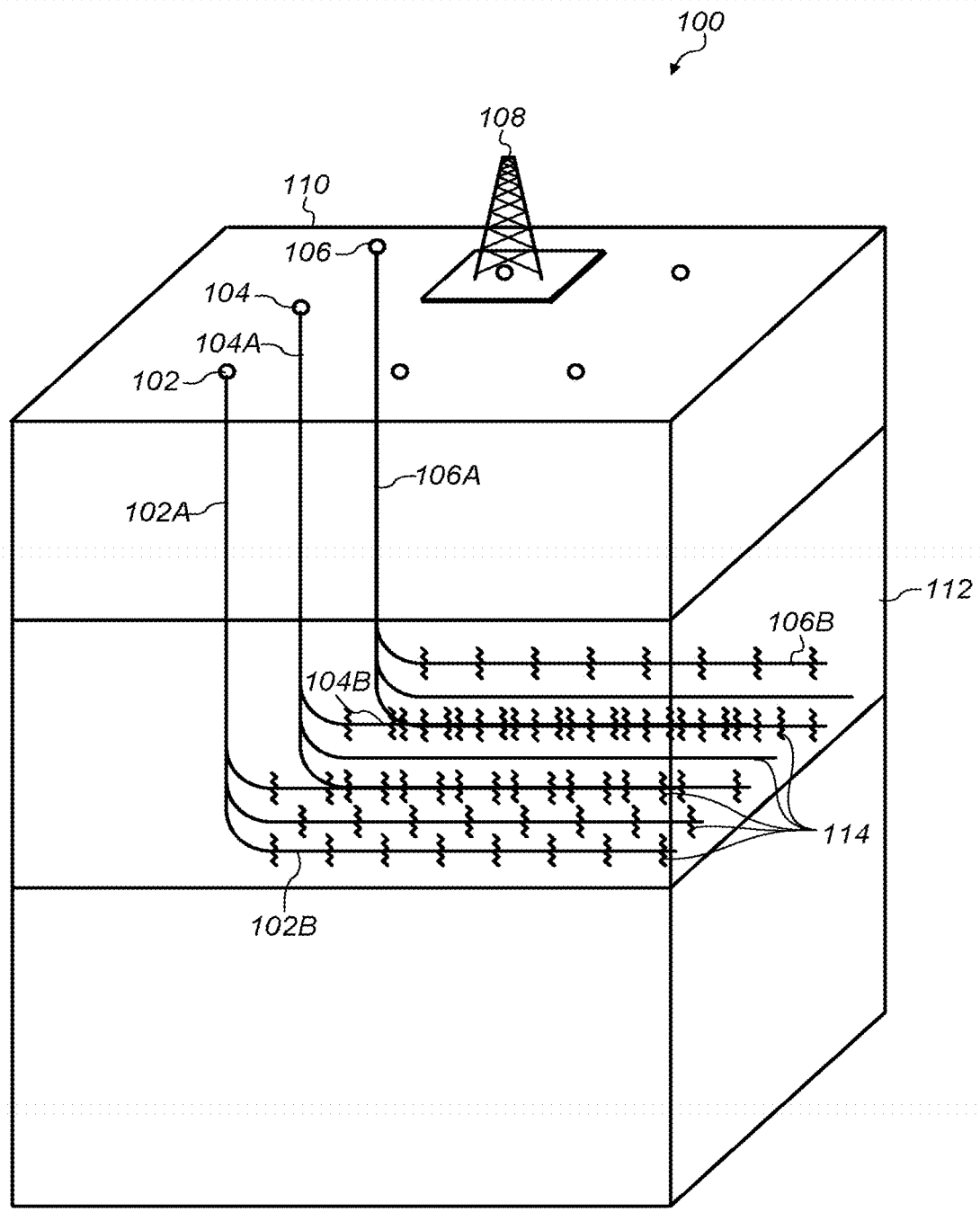
FIG. 3 depicts an example of an embodiment of a drilling operation on a multi-well pad.

FIG. 3 depicts an example of an embodiment of a drilling operation on a multi-well pad. It is to be understood that the drilling operation shown in FIG. 3 is provided for exemplary purposes only and that a drilling operation suitable for the embodiments described herein may include many different types of drilling operations suitable for hydraulic fracturing of hydrocarbon-bearing subsurface formations and/or other fracture treatments for such formations. For example, the number of groups of wellbores and/or the number of wellbores in each group are not limited to those shown in FIG. 3. It should also be noted that the wellbores may be, in some cases, be vertical wellbores without horizontal sections.

In certain embodiments, as depicted in FIG. 3, drilling operation 100 includes groups of wellbores 102, 104, 106 drilled by drilling rig 108 from single pad 110. Wellbores 102, 104, 106 may have vertical sections 102A, 104A, 106A that extend from the surface of the earth until reaching hydrocarbon-bearing subsurface formation 112. In formation 112, wellbores 102, 104, 106 may include horizontal sections 102B, 104B, 106B that extend horizontally from vertical sections 102A, 104A, 106A into formation 112. Horizontal sections 102B, 104B, 106B may increase or maximize the efficiency of oil recovery from formation 112. In certain embodiments, formation 112 is hydraulically stimulated using conventional hydraulic fracturing methods. Hydraulic stimulation may create fractures 114 in formation 112. It is to be understood that while FIG. 3 illustrates that several groups of wellbores 102, 104, 106 reach the same formation 112, this is provided for exemplary purposes only and, in some embodiments, the groups and the wellbores in different groups can be indifferent formations. For example, the groups and the wellbores may be in two different formations. According to an embodiment of the present invention, a method has been developed for evaluating hydraulic fracture geometry and optimizing well spacing for a multi-well pad by sequencing hydraulic fracturing jobs for the multi-well pad and monitoring the pressure in said monitor well while hydraulic fractures are created in adjacent well(s), so that highly valuable data can be acquired for analyzing to evaluate hydraulic fracture geometry, proximity, and connectivity.

Figure 4:
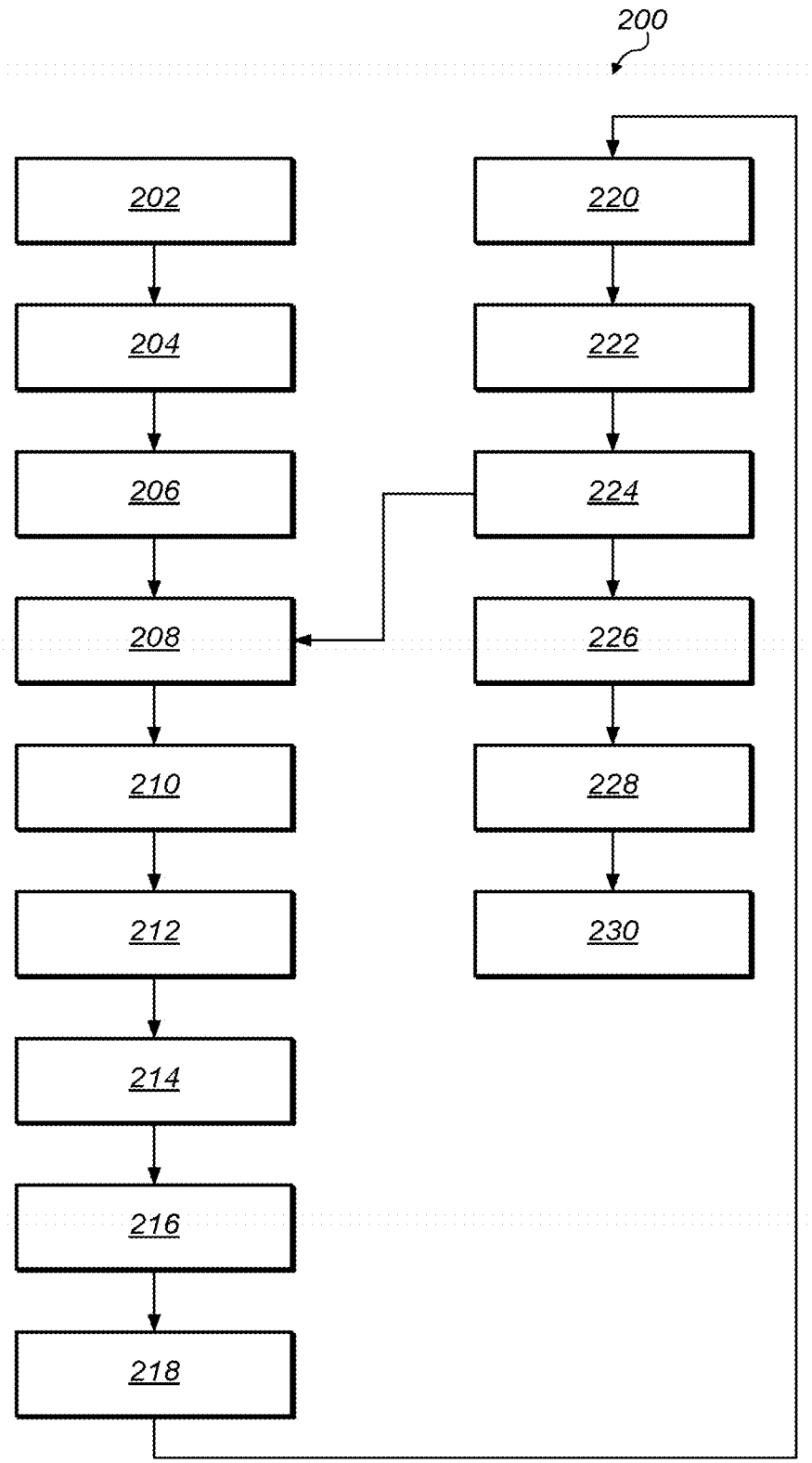
FIG. 4 depicts a flowchart of an embodiment of a process for assessing pressure signal data used to evaluate hydraulic fracturing in hydrocarbon-bearing subsurface formation.

FIG. 4 depicts a flowchart of an embodiment of process 200 for assessing pressure signal data used to evaluate hydraulic fracturing in hydrocarbon-bearing subsurface formation 112. In certain embodiments, process 200 is used to assess pressure between two wellbores in formation 112. In some embodiments, however, process 200 is used to assess pressure between three or more wellbores and/or wellbores in multiple groups of wellbores in formation 112.

In certain embodiments, at least two wellbores targeted for multi-stage hydraulic fracturing are identified in 202. In 204, monitoring wellbore is selected from the at least two wellbores. After the monitoring wellbore is selected, in 206, a pressure sensor (e.g., pressure gauge) is connected in direct fluid communication with the monitoring wellbore in order to monitor the pressure changes in the wellbore. The pressure sensor may be, but is not limited to, a surface pressure gauge or a subsurface pressure gauge. Surface pressure gauges may be simpler and less costly. Typically, surface gauges have been used for evaluating direct communication between wellbores and have not been used for determining hydraulic fracture properties such as proximity, geometry, overlap, etc. In certain embodiments, the surface gauge is used to acquire pressure information associated with an isolated observation stage in the monitoring wellbore. The surface gauge may also allow for data collection during a resting period so that the proximity and overlap of new fractures growing near the observation fractures may be determined using pressure signals recorded during the waiting period. Examples of subsurface gauges include, but are not limited to, downhole gauges, fiber gauges, or memory gauges. In some embodiments, subsurface gauges are placed in a plug (e.g., a bridge plug) used between stages. In some embodiments, the pressure gauge is a high-quality gauge with resolution below 1 psi (e.g., resolution of 0.1 psi) and a range of up to 10,000 psi. In certain embodiments, the surface pressure gauge is isolated. For example, the valve connecting the pressure gauge and the monitoring well is maintained closed from the wellbore during stimulation of the monitoring wellbore. In certain embodiments, the surface pressure gauge is not isolated. For example, the valve connecting the pressure gauge and the monitoring well is maintained opened to the wellbore during stimulation of adjacent wellbores.

In 208, a stage targeted for hydraulic fracturing of the monitoring wellbore is selected to be the observation stage. It is to be understood that any wellbore can be set as the monitor wellbore, and any stage from the first stage and up can be set as the observation stage. In 210, fractures may be created in the monitoring wellbore up to the stage immediately before the observation stage. The fracturing operation may be carried out using any suitable conventional hydraulic fracturing methods. The fractures emanating from the monitoring wellbore are in contact with a hydrocarbon-bearing subterranean formation (e.g., formation 112), which can be the same as the hydrocarbon-bearing subterranean formation being contacted with the fractures created in adjacent wellbore(s), or may be a different formation. In some embodiments, the fracturing operation includes sub-steps of: drilling a wellbore (borehole) vertically or horizontally; inserting production casing into the borehole and then surrounding with cement; charging inside a perforating gun to blast small holes into the formation; and pumping a pressurized mixture (fluid) of water, sand, and chemicals into the wellbore. The pressurized fluid may generate numerous fractures in the formation that will free trapped oil to flow to the surface. It is to be understood that the fracturing operation may be carried out using any suitable conventional hydraulic fracturing method known in the art and is not limited to the abovementioned sub-steps. In some embodiments, fractures may also be created in one or more adjacent wellbores while creating fracturing in the monitoring wellbore.

In some embodiments, after the fractures are created in the monitoring wellbore up to immediately before the observation stage, in 212, the observation stage may be isolated from the previously completed stages by an isolating device. The isolating device may be, but is not limited to, a bridge plug installed internally in the monitoring wellbore while swell-packers or cement exist externally around the wellbore before the observation stage. For example, if the observation stage is set to be stage 11 of the monitoring wellbore, the bridge plug should be installed after stage 10. The bridge plug may be retrievable and set in compression and/or tension and installed in the monitoring wellbore before the observation stage. In some embodiments, the bridge plug is on-retrievable and drilled out after the completions are finished. Other suitable isolation devices known in the art may also be used. In other embodiments, there is no isolation inside the wellbore between the observation stage in the monitoring wellbore and the stage prior to the observation stage in the monitoring wellbore.

In some embodiments, after the observation stage in the monitoring wellbore is isolated from the previously completed stages, in 214, a fracture may be created in the observation stage. In certain embodiments, during 214, the valve connecting the pressure gauge and the monitoring well may still remain closed. The fracturing operation may be carried out using any suitable conventional hydraulic fracturing method. The fracture emanating from this stage may be in contact with a hydrocarbon-bearing subsurface formation (e.g., formation 112). Step 214 may be used to ensure that there is sufficient mobile fluid to accommodate the compressibility in the monitoring wellbore and deliver the actual subsurface pressure signal. In some embodiments, during 214, the monitoring (observation) wellbore is perforated without creating a fracture in the formation. Perforation of the monitoring wellbore may create fluid communication between the wellbore and the formation that allows pressure measurement of the subsurface pressure signal in the wellbore. In other embodiments, a fracture is created in the observation stage without isolation in the wellbore between the observation stage and the stage prior to the observation stage within the monitoring well.

After completion of the observation stage, in 216, the valve for the pressure gauge connecting with the monitoring well may be opened such that the pressure gauge is in direct fluid communication with the observation stage in the monitoring wellbore. In some embodiments, the next stage in the monitoring wellbore may not be perforated until the pressure monitoring is completed. For example, if stage 11 of the monitoring wellbore is set to be the observation stage, stage 12 should not be perforated until the pressure monitoring for observation stage 11 is completed.

After the valve for the pressure gauge is opened, in 218, fracturing operations are performed in one or more adjacent wellbores that are in contact with the hydrocarbon-bearing subsurface formation. The adjacent wellbore may be adjacent to the monitor wellbore such that the fractures formed from the adjacent wellbore induce the pressure being measured in the monitoring wellbore to change (e.g., the fractures induce pressure changes in the monitoring wellbore). An adjacent wellbore may not be limited to an immediately adjacent wellbore or even a wellbore in the same formation or stratigraphic layer. For example, as long as the fractures from the "adjacent" wellbore may induce the pressure being measured in the monitoring wellbore to change, the wellbore may be considered an adjacent wellbore. In certain embodiments, the number of stages completed in each of the adjacent wellbores exceeds the number of stages completed in the monitoring wellbore.

In certain embodiments, at least two stages before the observation stage and at least two stages after the observation stage in the adjacent wellbore should be completed in 218 while the pressure in the monitoring wellbore is monitored by the pressure gauge. For example, if stage 11 of the monitoring wellbore is set to be the observation stage, at least stages 9-13 in the adjacent wellbore should be completed in 218 while the pressure in the monitoring well is monitored by the pressure gauge. In some embodiments, at least four stages before the observation stage and at least four stages after the observation stage in the adjacent wellbore should be completed in 218. In some embodiments, the stage numbers in the monitoring wellbore and the adjacent wellbore may or may not correspond to each other depending on the wellbore length, stage placement, and fracture orientation. When the stage numbers in the monitoring wellbore and the adjacent wellbore do not correspond to each other, the stages being completed in the adjacent wellbore, while the pressure in the monitoring wellbore is monitored by the pressure gauge, typically includes stages both before and after the observation stage. In some cases, it may be possible to include stages other than those before and after the observation stage. For example, if there are fractures at a 45° angle, stages further away may be monitored (e.g., stage 10 observation stage may be used to monitor while stages 14-18 are completed in the adjacent well). Determining the monitoring stage numbers and identifying the adjacent wellbore stages influencing the pressure in the monitoring stage may not be straight forward. For example, the wellbores may not be drilled in alignment with the minimum horizontal compressive stress direction, since in such a case the induced fractures may be oblique to the well axis. In such embodiments, however, data collection may be enhanced because the dataset is very rich, covering a large space on the pore pressure map. During 218, no molecule contained in the fracture created in the monitoring wellbore physically interacts with a molecule contained in the fracture created in the adjacent wellbore, and no molecule existing in the fracture created in the monitoring wellbore exists in the fracture created in the adjacent wellbore simultaneously.

The measured pressures may be recorded (assessed) in 220. After the monitoring is completed, in 222, the valve connecting the pressure gauge and the monitoring wellbore may be closed. Further fracturing operations may then be performed in the next stage in the monitoring wellbore. In 224, a determination may be made to decide whether more data is needed, and if yes, one or more steps in process 200 (including steps 208-224) may be repeated as many times as desired. The repeating operation may start with selecting a new observation stage. In certain embodiments, two or three observation stages are selected for process 200 in one monitoring wellbore. In some embodiments, however, more than one monitoring wellbore may be used, and in such embodiments, one observation stage per monitoring wellbore may be sufficient.

Figure 5:
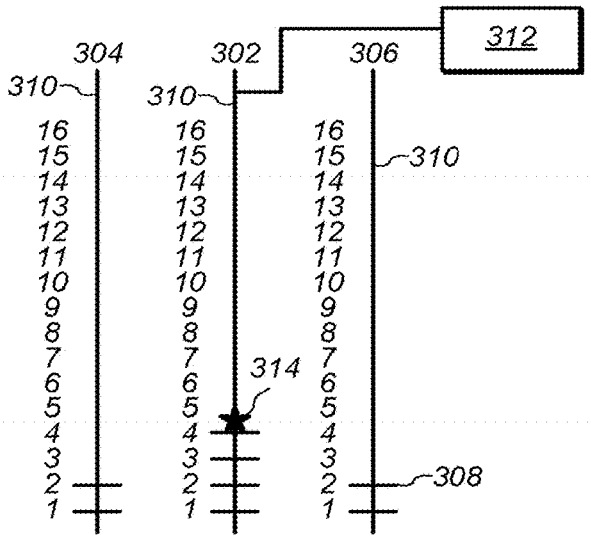
FIG. 5 shows a group of wellbores represented by vertical lines including three wellbores.
Figure 6:
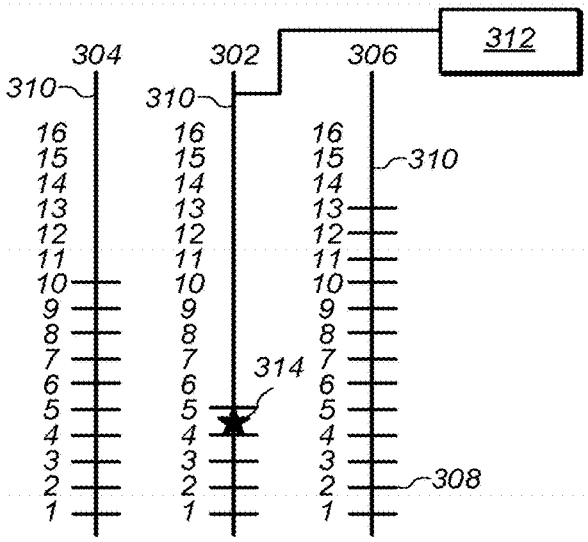
FIG. 6 shows a group of wellbores after a stage of a wellbore is isolated.
Figure 7:
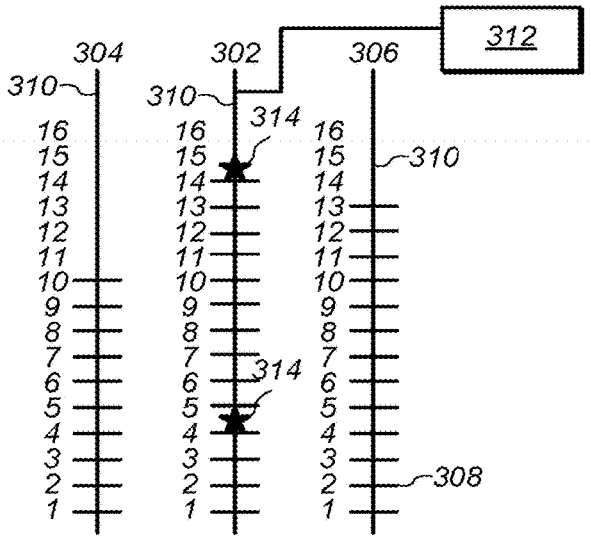
FIG. 7 shows a group of wellbores after the monitoring is completed.

FIGS. 5-7 depict diagrams of an example of an embodiment of the stage sequencing of a hydraulic fracturing operation for a multi-well pad. FIG. 5 shows a group of wellbores represented by the vertical lines 300 including three wellbores—wellbore 302, wellbore 304, and wellbore 306. It is to be understood that the numbers of groups of wellbores and the types of wellbores in terms of the formation are not limited to those shown in FIGS. 5-7. In some embodiments, wellbore 302, wellbore 304, and wellbore 306 are not limited to be in the same formation and they may be in different formations. In certain embodiments, horizontal lines 308 intersecting vertical lines 310 illustrate fractures created in each wellbore. The numbers beside horizontal lines 308 illustrate the sequencing of the stages in each wellbore. As shown in FIG. 5, wellbore 302 is selected to be the monitor well, and stage 5 of wellbore 302 is set to be the observation stage. Pressure gauge 312 may be connected to the monitoring wellbore (wellbore 302), and the valve connecting the pressure gauge and the monitoring wellbore remains closed until the observation stage is completed. Two stages have been completed in each of wellbore 304 and wellbore 306. For the monitoring wellbore, wellbore 302, since stage 5 has been set to be the observation stage, the fracturing operations are performed up to stage 4. The number of stages completed in each wellbore is not limited to the illustration in FIG. 5. In certain embodiments, as shown in FIG. 5, however, the stress orientations are chosen such that the number of stages completed in wellbore 302 at this time exceed the number of stages completed in each of wellbore 304 and wellbore 306. After stage 4 of wellbore 302 is completed, a bridge plug, represented by star 314, is installed between stage 4 and stage 5 in the wellbore. Bridge plug 314 may isolate stage 5, the observation stage, from the previously completed stages in wellbore 302.

Turning to FIG. 6, after stage 5 of wellbore 302 is isolated, a fracture is created in stage 5. After the fracturing of stage 5 in wellbore 302 is completed, the valve connecting pressure gauge 312 to the wellbore is opened such that the pressure gauge is in direct fluid communication with the isolated stage 5 in the wellbore. At this time, stage 6 in wellbore 302 has not yet been prepared by plugging and perforating. The plugging and perforating operation mentioned herein may adopt any suitable conventional systems such as, but not limited to, the open-hole (OH) graduated ball-drop fracturing isolation system where the ball isolates the next stage from the previous stage. In some embodiments sliding sleeves may be used to isolate stages. "Direct fluid communication" may be defined as a measureable pressure response in pressure gauge 312 induced by advective or diffusive mass transport. After the valve for connecting pressure gauge 312 to wellbore 302 is opened and the pressure gauge is in direct fluid communication with the isolated stage 5 in the wellbore, another eight stages of fracturing operations have been performed in wellbore 304 and another twelve stages of fracturing operations have been performed in wellbore 306, while pressure gauge 312 is monitoring the pressure changes in wellbore 302. Since wellbore 304 and wellbore 306 are adjacent wellbores of the monitor wellbore (wellbore 302), the fracturing operations performed in wellbore 304 and wellbore 306 induce the pressure being measured by pressure gauge 312 in wellbore 302 to change. The pressure change may be recorded (assessed) for further processing as described herein.

Turning to FIG. 7, after the monitoring is completed, the valve for connecting pressure gauge 312 to wellbore 302 may be closed. Stage 6 in wellbore 302 may then be perforated for preparation of performing a fracturing operation. In the embodiment shown in FIG. 7, a determination for obtaining more monitoring data is made, and a repeating operation, as in process 200 mentioned above, may be performed. As shown in FIG. 7, stage 15 in wellbore 302 may be set to be the new observation stage, and then fracturing operations are performed in stage 6 to stage 14 in the wellbore. After setting the new observation stage, the new observation stage, stage 15, may be isolated from the previously completed stages, for example, by installing bridge plug 314 between stage 14 and stage 15 in wellbore 302. After isolating stage 15, the procedure as mentioned above in process 200 may be performed. The pressure assessment operation may be performed and repeated as many times as desired until sufficient pressure monitoring data is obtained.

Figure 8:
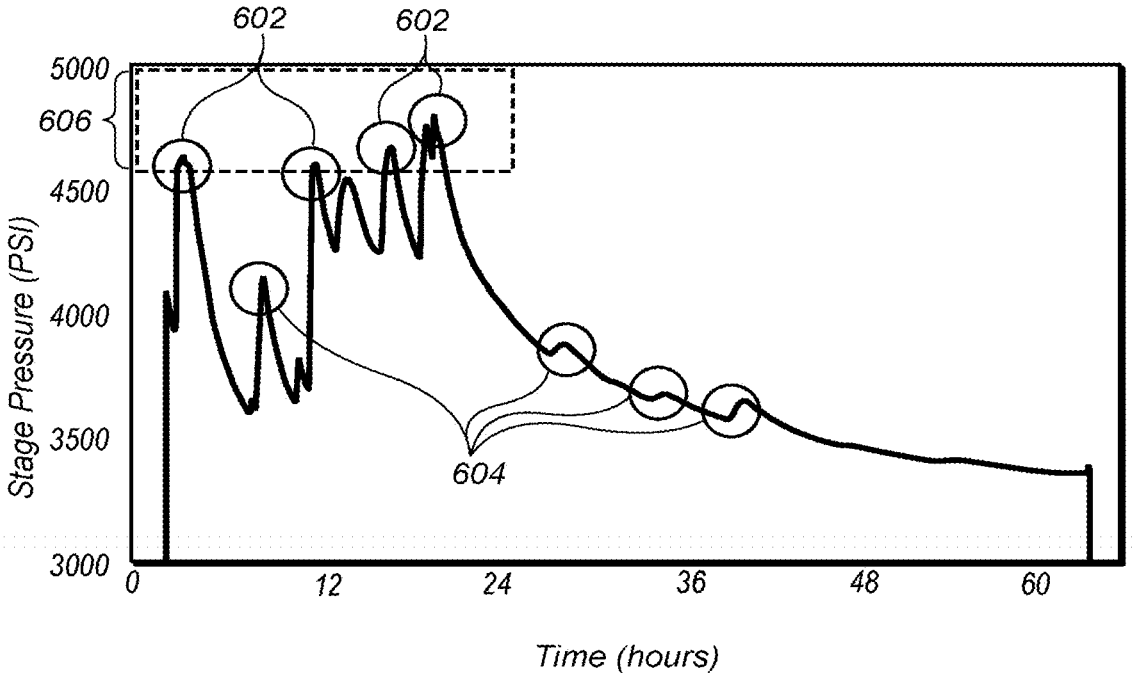
FIG. 8 depicts an example of a pressure versus time curve.

FIG. 8 depicts an example of a pressure versus time curve (e.g., a pressure log) that may be obtained using process 200 and the monitoring wellbore described above. In certain embodiments, the pressure versus time curve (curve 600 shown in FIG. 8) is for a single observation stage in an observation wellbore during multiple stages of injection in a stimulation wellbore. As described herein, a stage of injection may include a time from the start of injection (e.g., start injecting fracturing fluid), time for injection, stopping of on injection, and a selected time after injection is stopped (e.g., a time for additional fluid flow/pressure flow after injection is stopped). In some embodiments, a stage of injection may include multiple start/stop cycles of injection (e.g., multiple start/stop stages are completed on a single wellbore stage before isolation of the wellbore stage).

In certain embodiments, as shown in FIG. 4, process 200 includes identifying one or more pressure-induced poromechanic signals 226. The pressure-induced poromechanic signals may be identified using pressure signals (e.g., a pressure log) assessed in 220. In certain embodiments, the pressure signals or pressure log include a pressure versus time curve (such as curve 600 shown in FIG. 8) of the pressure signal assessed in 220. Pressure-induced poromechanic signals may be identified in the pressure versus time curve and the pressure-induced poromechanic signals may be used to assess one or more parameters (e.g., geometry) of the fracture system in the hydrocarbon-bearing subsurface formation.

As used herein, a "pressure-induced poromechanic signal" refers to a recordable change in pressure of a first fluid in direct fluid communication with a pressure sensor (e.g., pressure gauge) where the recordable change in pressure is caused by a change in stress on a solid in a subsurface formation that is in contact with a second fluid, which is in direct fluid communication with the first fluid. The change in stress of the solid may be caused by a third fluid used in a hydraulic stimulation process (e.g., a hydraulic fracturing process) in a stimulation wellbore in proximity to (e.g., adjacent) the observation (monitoring) wellbore with the third fluid not being in direct fluid communication with the second fluid.

For example, a pressure-induced poromechanic signal may occur in a surface pressure gauge attached to the wellhead of an observation wellbore, where at least one stage of that observation wellbore has already been hydraulically fractured to create a first hydraulic fracture, when an adjacent stimulation wellbore undergoes hydraulic stimulation. A second fracture emanating from the stimulation wellbore may grow in proximity to the first fracture but the first and second fractures do not intersect. No fluid from the hydraulic fracturing process in the stimulation wellbore contacts any fluid in the first hydraulic fracture and no measureable pressure change in the fluid in the first hydraulic fracture is caused by advective or diffusive mass transport related to the hydraulic fracturing process in the stimulation wellbore. Thus, the interaction of the fluids in the second fracture with fluids in the subsurface matrix does not result in a recordable pressure change in the fluids in the first fracture that can be measured by the surface pressure gauge. The change in stress on a rock in contact with the fluids in the second fracture, however, may cause a change in pressure in the fluids in the first fracture, which can be measured as a pressure-induced poromechanic signal in a surface pressure gauge attached to the wellhead of the observation wellbore.

The term "direct fluid communication" between a first fluid and a second fluid as used herein refers to an instance where the motion of a first fluid or the change in a state property (e.g., pressure) of a first fluid has the ability to directly influence a measureable change in the pressure of the second fluid through direct contact between the fluids. For example, water molecules on one side of the pool are in direct fluid communication with water molecules on the other side of the pool. Similarly, water molecules near the surface pressure gauge in an observation wellbore are in direct fluid communication with water molecules in the observation wellbore in the subsurface formation, provided there is no barrier in between the fluids. Fluid molecules in the observation wellbore in the subsurface formation may be in direct fluid communication with fluid molecules in a hydraulic fracture emanating from the observation wellbore, provided there is no barrier in between and the permeability of the hydraulic fracture is sufficient to allow fluid motion in the hydraulic fracture to influence the pressure of fluid molecules in the observation wellbore. In shale formations and ultra-low permeability formations, however, the permeability can be extremely low, in some cases less than 1 millidarcy, in some cases less than 1 microdarcy, and in some cases less than 10 nanodarcy. In such formations, fluid molecules in a first fracture emanating from an observation wellbore are not in direct fluid communication, as defined herein, with fluid molecules in an unconnected second fracture emanating from a stimulation wellbore when an ultra-low permeability formation with 90% of the bulk volume of the formation separating the fractures has permeability less than 0.1 millidarcy or less than 0.01 millidarcy.

Poromechanic signals may be present in traditional pressure measurements taken in an observation wellbore while fracturing an adjacent well. For example, if a newly formed hydraulic fracture overlaps or grows in proximity to a hydraulic fracture in fluid communication with the pressure gauge in the observation wellbore, one or more poromechanic signals may be present. However, poromechanic signals may be smaller in nature than a direct fluid communication signal (e.g., a direct pressure signal induced by direct fluid communication such as a direct fracture hit or fluid connectivity through a high permeability fault). Poromechanic signals may also manifest over a different time scale that direct fluid communication signals. Thus, poromechanic signals are often overlooked, unnoticed, or disregarded as data drift or error in the pressure gauges themselves.

Poromechanic signals, however, may represent important physical processes in the subsurface that heretofore have not been recognized. Typically, poromechanic signals are not sought for when looking at pressure data from an adjacent well during a fracturing process as they do not represent direct fracture hit signals. Poromechanic signals may be used to gain greater insight into hydraulic fracture geometries than other pieces of data that are currently collected to understand the hydraulic fracturing process. Recent developments for shale formations have provided the ability to map hydraulic fractures by coupling knowledge of solid mechanics and fluid mechanics and use poromechanic theory on such formations (described herein and in U.S. patent application Ser. No. 14/788,056 entitled "INTEGRATED MODELING APPROACH FOR GEOMETRIC EVALUATION OF FRACTURES (IMAGE FRAC)" to Kampfer and Dawson, which is incorporated by reference as if fully set forth herein). Poromechanic signals within pressure signal data (e.g., pressure versus time curves such as curve 600, shown in FIG. 8) need to be identified in order to use the poromechanic theory map hydraulic fractures. Identifying poromechanic signals may include differentiating the poromechanic signals from signals caused by direct fluid connectivity (e.g., direct pressure signals induced by direct fluid communication).

Direct fluid connectivity signals may be classified into three main classes. The first class may arise when a "direct fracture hit occurs." A direct fracture hit may be defined as a case where a hydraulically created fracture in a stimulated wellbore intersects hydraulic fractures (existing or being created) emanating from an observation wellbore or intersects the observation wellbore itself. The intersection of fractures allows fluid from the stimulated fracture to contact fluid in direct communication with the pressure gauge in the observation wellbore. The second class may arise when a hydraulically created fracture intersects a fault or high permeability channel in the formation. The fault or high permeability channel may also intersect a fracture emanating from the observation wellbore or intersect the observation wellbore itself. The third class may arise when a natural fracture or low-permeability channel allows for fluid communication between a hydraulically created fracture in a stimulated wellbore and fluid in communication with the observation wellbore (residing either in the wellbore itself or in a hydraulically created fracture emanating from the observation wellbore).

In certain embodiments, identifying one or more pressure-induced poromechanic signals 226, shown in FIG. 4, includes differentiating the pressure-induced poromechanic signals from pressure signals due to one of the three classes of direct fluid connectivity signals (e.g., direct pressure signals induced by direct fluid communication between the stimulation wellbore and the observation wellbore). Pressure-induced poromechanic signals may be differentiated from direct pressure signals using one or more different selected criteria that can be observed in a pressure versus time curve such as curve 600, shown in FIG. 8. Curve 600 includes examples of direct pressure signals 602 and examples of pressure-induced poromechanic signals 604. It is to be understood that signals 602 and signals 604 on curve 600, shown in the representative embodiment of FIG. 8, are provided as examples of different types of pressure signals that may be seen but that these examples are not exclusive and application of the criteria described below may be used to differentiate pressure-induced poromechanic signals from direct pressure signals for various embodiments of pressure versus time curves. In certain embodiments, a poromechanic signal is differentiated from a direct fracture hit induced signal using the time rate of change of a pressure-induced poromechanic signal during the hydraulic fracturing process (e.g., during stimulation in the stimulated wellbore).

In certain embodiments, after one or more pressure-induced poromechanical signals are identified, process 200, as shown in FIG. 4, includes assessing one or more properties of the subsurface formation and/or the fracturing process in 228 (e.g., assessing the pressure-induced poromechanic signals identified in 226). For example, a geometric parameter of the stimulation wellbore fracture may be assessed from a pressure-induced poromechanical signal and/or an area of overlap between a projection orthogonal to the observation wellbore fracture and a projection orthogonal to the stimulation wellbore fracture may be assessed from the pressure-induced poromechanical signal. Analyzing hydraulic fracture geometries using the identified pressure-induced poromechanical signals may provide a more accurate analysis of the hydraulic fracture geometry than current techniques known in the art.

Figure 9:
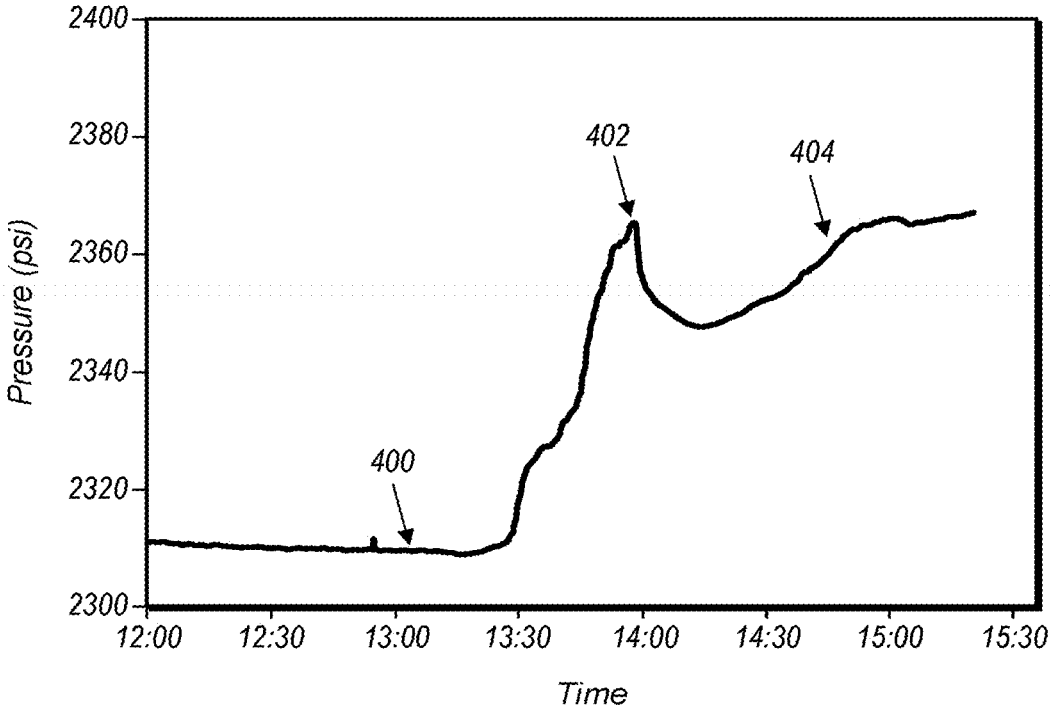
FIG. 9 depicts a representative plot of pressure versus time showing a diverter drop effect on fracture growth.

In certain embodiments, the identified pressure-induced poromechanical signals are used to monitor fracture growth rate and identify when fractures slow or stop growth. Monitoring fracture growth rate and identifying when fractures slow or stop growth may be used to assess the effectiveness of a diverter placed in the stimulation wellbore. FIG. 9 depicts a representative plot of pressure versus time showing a diverter drop effect on fracture growth. The plot in FIG. 9 shows the pressure change, as measured by pressure in an observation stage, induced by injection of fluid at an applied net pressure in the stimulation wellbore. Changes in pressure may be used as an indication of growth of the largest fracture from the stimulation wellbore. Point 400 is the start of injection into the stimulation wellbore. There is initially no overlap between the stimulated fracture and the observation fracture as indicated by no initial pressure change. As overlap between the stimulated fracture and the observation fracture begin, the pressure begins to rise and continues to rise as the stimulated fracture grows.

At point 402, the diverter is provided (dropped or injected) into the stimulation wellbore. As shown in the plot in FIG. 9, the pressure in the observation stage decreases after the diverter drop. This pressure drop indicates that the diverter is effective in impeding or stopping growth of the largest fracture from the stimulation wellbore. It may be assumed that the diverter may actually stop growth of the largest fracture as the pressure actually decreases after the diverter drop. The decline in pressure may be attributed to leak off in the largest fracture (e.g., pressure leak off from the fracture). In certain embodiments, the applied net pressure after the diverter drop is equal to or greater than the applied net pressure before the diverter drop. Thus, as shown in the plot in FIG. 9, the pressure may decline despite the greater applied net pressure in the stimulation wellbore.

The later pressure rise in the plot in FIG. 9 may be attributed to the growth of a second fracture that, with the continued injection, eventually overlaps the observation fracture and begins to show pressure increase in the observation wellbore. At 404, the injection is stopped. The second fracture may grow to be about the same size as the first (largest) fracture with growth stopped by the diverter as evidenced by the relatively equivalent end pressure after injection is stopped.

Figure 10:
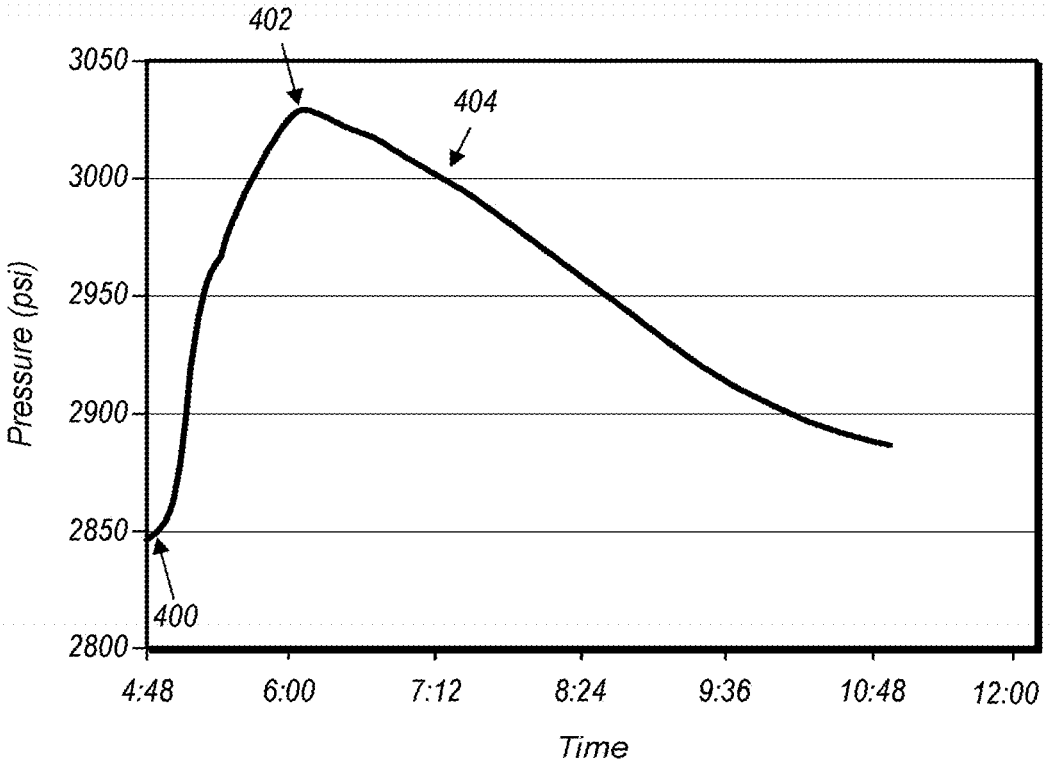
FIG. 10 depicts another representative plot of pressure versus time showing a diverter drop effect on fracture growth.

In some embodiments, the pressure decline after an effective diverter drop may be different from the plot in FIG. 9. FIG. 10 depicts another representative plot of pressure versus time showing a diverter drop effect on fracture growth. The plot in FIG. 10 shows a similar fracture growth after the start of injection at 400. At 402, the diverter is dropped and the slope of the pressure change (e.g., the slope of the pressure versus time curve) turns over indicating the diverter is effective in stopping or impeding fracture growth, though the slope change is not as dramatic as the slope change in FIG. 9. The pressure continues to slowly decline until injection is stopped at 404. Note that the plot in FIG. 10 does not show any increase in pressure after the diverter drop. The lack of pressure increase may indicate that other fractures do not exceed the length of the first fracture.

While the plots in FIGS. 9 and 10 show that the diverters effectively stop the growth of fractures as indicated by the change in the slope of the pressure change to a declining slope (e.g., a pressure change reversal from positive slope to negative slope), such dramatic changes in the slope of the pressure change may be only one indication that the diverter is effective. In certain embodiments, a reduction in the slope of the pressure versus time curve after the diverter drop indicates that there is at least some reduction in the growth rate of the largest fracture (e.g., fracture growth is inhibited (i.e., impeded or stopped)). Thus, reduction in the slope of the pressure versus time curve (reduction in the slope of the pressure change) may indicate that the diverter is being, at least partially, effective in inhibiting or slowing growth of the largest fracture (e.g., reducing the growth rate of the largest fracture).

Figure 11:
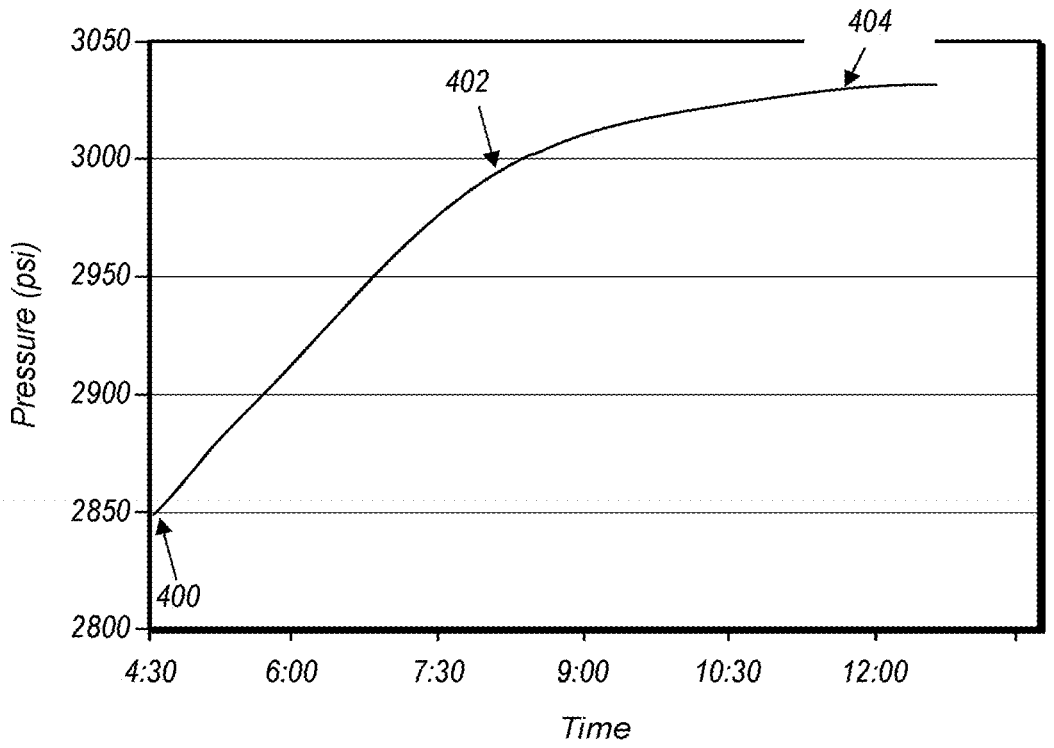
FIG. 11 depicts a representative plot of pressure versus time showing a diverter drop that reduces the growth rate of the largest fracture.
Figure 12:
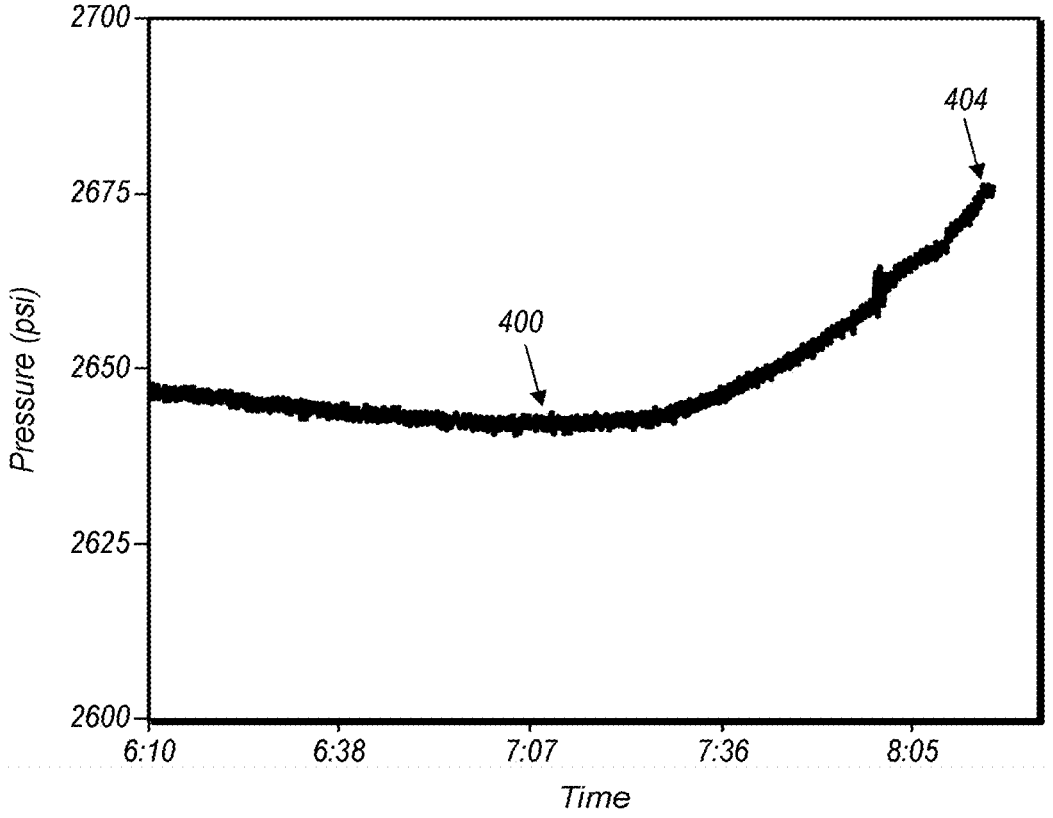
FIG. 12 depicts a representative plot of pressure versus time showing pressure change without a diverter.

FIG. 11 depicts a representative plot of pressure versus time showing a diverter drop that reduces the growth rate of the largest fracture. As shown in the plot in FIG. 11, the slope of the pressure versus time curve after the diverter drop at 402 is less than the slope of the pressure versus time curve before the diverter drop. Despite that the pressure continues to go up after the diverter drop, the rate of growth of the largest fracture may be reduced by the diverter as shown by the slope change in the pressure versus time curve (if the applied net pressure after the diverter drop is the same or greater as the applied net pressure during fracturing before the diverter drop and the fracture height is substantially the same after the diverter drop). FIG. 12 depicts a representative plot of pressure versus time showing pressure change without a diverter. The plot in FIG. 12 shows that, without the diverter, the pressure versus time curve may have a relatively constant slope once fracture overlap begins.

As shown by the above representative plots of pressure versus time in FIGS. 9-12, the slope of the pressure versus time curve may correlate to whether a diverter is working to inhibit fracture growth. Thus, the slope of the pressure versus time curve may be assessed to determine if a diverter is, at least partially, effective in inhibiting or slowing growth of the largest fracture emanating from the stimulation wellbore. Being able to identify if a diverter is working, at least in some respect, is important as diverters may be used to control fracture length. For example, a highly effective diverter may be used to reduce fracture length by around 35-40% while a moderately effective diverter may reduce fracture length by around 15-20%. Thus, being able to assess diverter effectiveness is important in controlling fracture growth and fracture stimulation during hydraulic fracturing processes.

Figure 13:
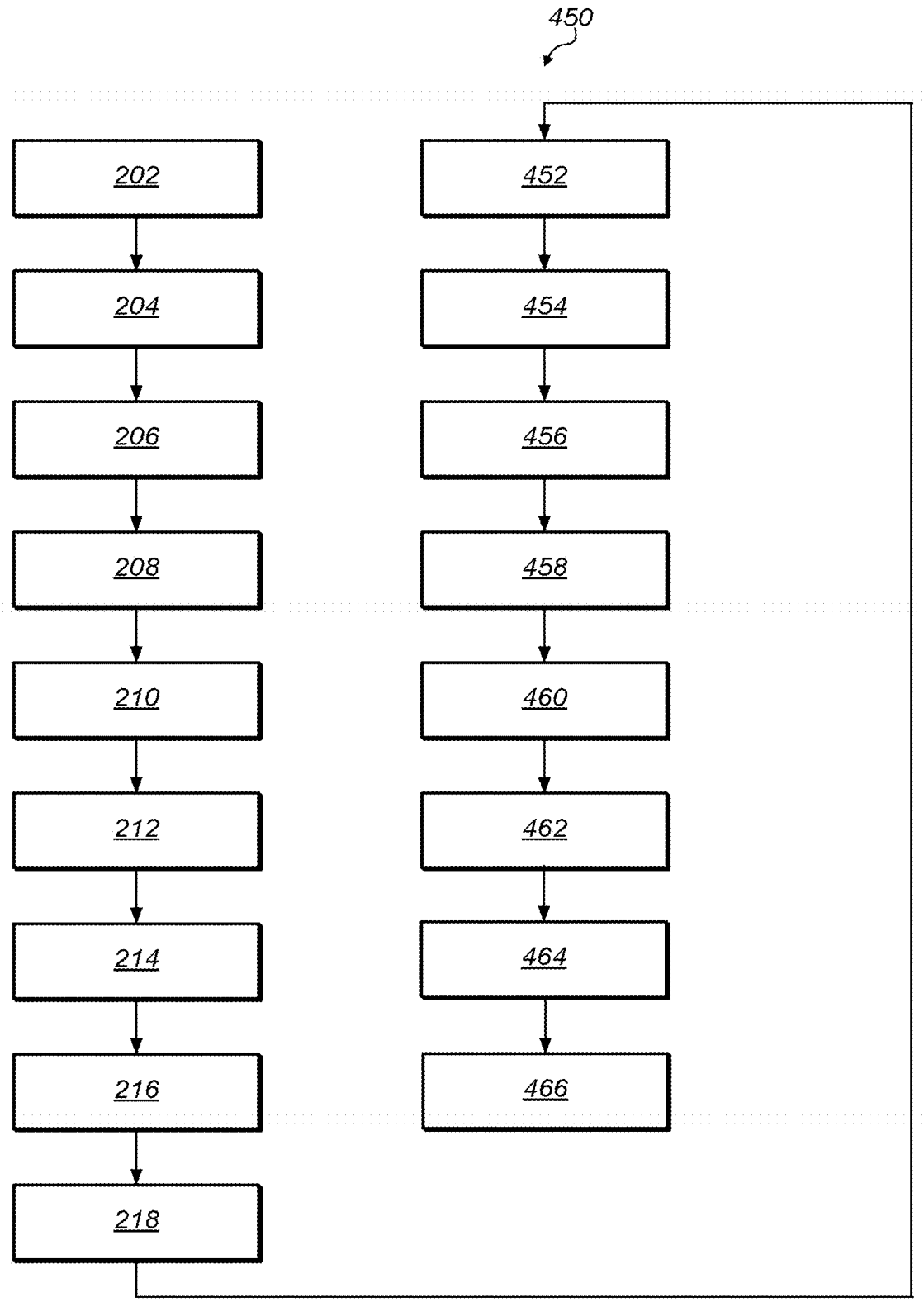
FIG. 13 depicts a flowchart of an embodiment of a process for assessing diverter effectiveness in a stimulation wellbore.

FIG. 13 depicts a flowchart of an embodiment of process 450 for assessing diverter effectiveness in a stimulation wellbore. In certain embodiments, process 450 begins with steps 202-218 from the embodiment of process 200, shown in FIG. 4. In 218, a fracture may be formed in the stimulation wellbore. The fracture may be formed from a first interval (e.g., a first stage) in the adjacent wellbore. In 452, a first applied net pressure may be induced in the created fracture. A pressure signal in an observation wellbore may be measured (assessed) in 454. The pressure signal may be induced by the first applied net pressure in the created fracture.

Figure 14:
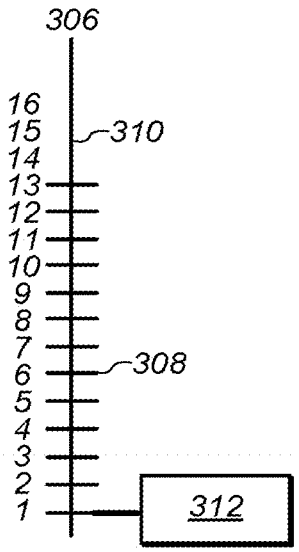
FIG. 14 depicts a stimulation wellbore with an observation stage and a stimulation stage.

In some embodiments, in 454, the pressure signal is measured in the stimulation wellbore. For example, the pressure signal may be measured in another stage in the stimulation wellbore such as a previous stage. FIG. 14 depicts stimulation wellbore 306 with stage (interval) 1 being used as an observation stage and stage (interval) 2 being used as a stimulation stage. In certain embodiments, pressure gauge 312 is placed in the observation stage (e.g., stage 1). Pressure gauge 312 may be, for example, a downhole pressure gauge, a fiber gauge, or a memory gauge. In some embodiments, pressure gauge 312 is placed in a plug (e.g., a bridge plug) between stages. For example, pressure gauge 312 may be a memory gauge in the plug between stage 1 and stage 2. In certain embodiments, pressure gauge 312 in stage 1 is used to measure the pressure signal induced by fracturing being completed from stage 2.

In certain embodiments, as shown in FIG. 13, one or more pressure-induced poromechanic signals are identified in 456 from the pressure signal measured in the observation wellbore (or observation stage) in 454. In 456, as described herein and similar to the embodiment of 226 in process 200, depicted in FIG. 4, pressure-induced poromechanic signals may be identified using pressure signals (e.g., a pressure log) assessed in 454. One or more of the pressure-induced poromechanic signals may be used to assess the effectiveness of a diverter provided into the stimulation wellbore. In 458, before the diverter is provided into the stimulation wellbore, a first slope in the pressure signal (e.g., the pressure-induced poromechanic signal) may be assessed. The slope may be the slope of a pressure versus time curve, as described herein. In certain embodiments, the first slope in the pressure signal is the slope after overlap between the stimulation fracture (the fracture created in 218) and the observation fracture. For example, the first slope in the pressure signal is the slope after the pressure in the observation wellbore begins to rise (change).

As the pressure (e.g., the pressure-induced poromechanic signals) is being assessed, a diverter may be provided into the stimulation wellbore in 460. The diverter may be injected or otherwise provided into the stimulation wellbore. In certain embodiments, the diverter is directed to inhibit growth of the fracture created in 218. In some embodiments, a second applied net pressure is induced into the created fracture in 462 after the diverter is provided into the stimulation wellbore. The second applied net pressure may be equal to or greater than the first applied net pressure.

In 464, a second slope in the pressure signal (e.g., the pressure-induced poromechanic signal) may be assessed while the second applied net pressure is induced. The second slope in the pressure signal may then be compared to the first slope in the pressure signal in 466. Comparison of the second slope and the first slope may be used to determine the effectiveness of the diverter. For example, the diverter may be determined to be effective in inhibiting growth of the created fracture if the second slope is less than the first slope. The second slope may be less than the first slope if the pressure versus time curve becomes flatter or the pressure begins to decrease (e.g., the second slope is negative). As shown above, the pressure signal (e.g., the pressure-induced poromechanic signal) may be used to more reliably and effectively assess whether a diverter is effective in inhibiting fracture growth from the stimulation wellbore in a hydraulic fracturing process.

In some embodiments, the pressure before the diverter is provided into the stimulation wellbore is compared to the pressure after the diverter is provided into the stimulation wellbore to determine the effectiveness of the diverter. In such embodiments, step 458 may include assessing a first pressure in the pressure signal while the first applied net pressure is provided in the created fracture. The first pressure may be assessed a selected time before the diverter is provided into the stimulation wellbore during application of the first applied net pressure. For example, the first pressure may be assessed just before the diverter is provided into the stimulation wellbore. After the diverter is provided into the stimulation wellbore, step 464 may include assessing a second pressure in the pressure signal while the second applied net pressure is provided in the created fracture. The second pressure may be assessed a selected time after the diverter is provided into the stimulation wellbore. For example, the second pressure may be assessed immediately, or a short amount of time, after the diverter is provided into the stimulation wellbore.

The second pressure in the pressure signal may then be compared to the first pressure in the pressure signal in 466. Comparison of the second pressure and the first pressure may be used to determine the effectiveness of the diverter. In certain embodiments, the diverter is determined to be effective in inhibiting growth of the created fracture if the second pressure is less than the first pressure. For example, the diverter may be effective if the pressure in the observation wellbore (or observation stage) after the diverter is provided into the stimulation wellbore decreases to a pressure that is less than the pressure just before the diverter is provided into the stimulation wellbore, as shown in FIGS. 9 and 10.

In certain embodiments, one or more process steps described herein may be performed by one or more processors (e.g., a computer processor) executing instructions stored on a non-transitory computer-readable medium. For example, process 200 shown in FIG. 4 and/or process 450 shown in FIG. 13 may have one or more steps performed by one or more processors executing instructions stored as program instructions in a computer readable storage medium (e.g., a non-transitory computer readable storage medium).

Figure 15:
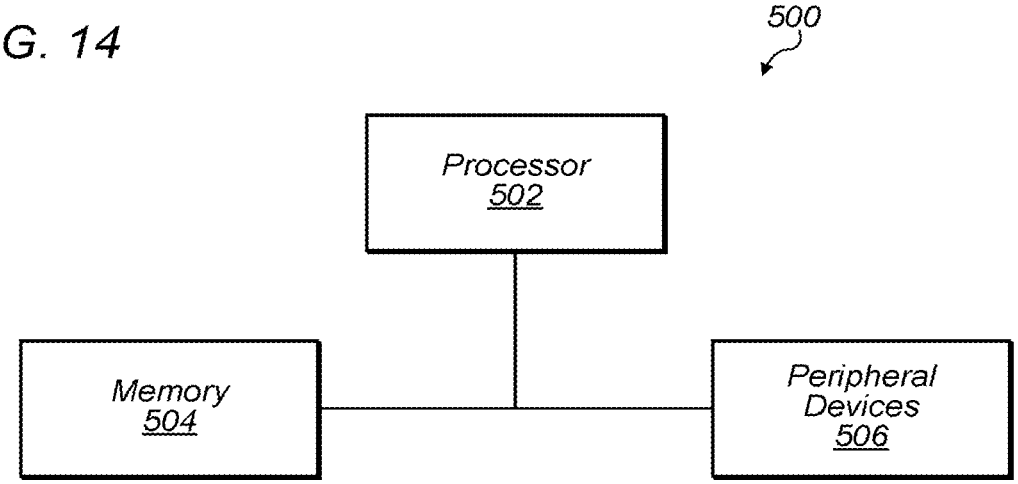
FIG. 15 depicts a block diagram of one embodiment of an exemplary computer system.

FIG. 15 depicts a block diagram of one embodiment of exemplary computer system 500. Exemplary computer system 500 may be used to implement one or more embodiments described herein. In some embodiments, computer system 500 is operable by a user to implement one or more embodiments described herein such as, but not limited to, process 200, shown in FIG. 4. In the embodiment of FIG. 15, computer system 500 includes processor 502, memory 504, and various peripheral devices 506. Processor 502 is coupled to memory 504 and peripheral devices 506. Processor 502 is configured to execute instructions, including the instructions for process 200, which may be in software. In various embodiments, processor 502 may implement any desired instruction set (e.g., Intel Architecture-32 (IA-32, also known as ×86), IA-32 with 64 bit extensions, ×86-64, PowerPC, Spark, MIPS, ARM, IA-64, etc.). In some embodiments, computer system 500 may include more than one processor. Moreover, processor 502 may include one or more processors or one or more processor cores.

Processor 502 may be coupled to memory 504 and peripheral devices 506 in any desired fashion. For example, in some embodiments, processor 502 may be coupled to memory 504 and/or peripheral devices 506 via various interconnect. Alternatively or in addition, one or more bridge chips may be used to coupled processor 502, memory 504, and peripheral devices 506.

Memory 504 may comprise any type of memory system. For example, memory 504 may comprise DRAM, and more particularly double data rate (DDR) SDRAM, RDRAM, etc. A memory controller may be included to interface to memory 504, and/or processor 502 may include a memory controller. Memory 504 may store the instructions to be executed by processor 502 during use, data to be operated upon by the processor during use, etc.

Figure 16:
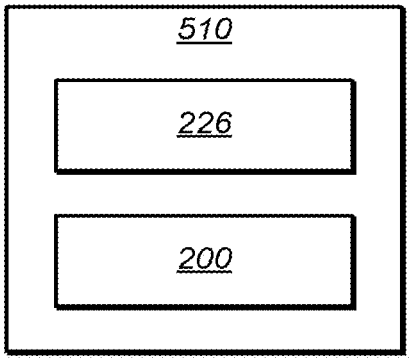
FIG. 16 depicts a block diagram of one embodiment of a computer accessible storage medium.

Peripheral devices 506 may represent any sort of hardware devices that may be included in computer system 500 or coupled thereto (e.g., storage devices, optionally including computer accessible storage medium 510, shown in FIG. 16, other input/output (I/O) devices such as video hardware, audio hardware, user interface devices, networking hardware, etc.).

Turning now to FIG. 16, a block diagram of one embodiment of computer accessible storage medium 510 including one or more data structures representative of identified pressure-induced poromechanical signals (found in 226 in process 200 depicted in FIG. 4) and one or more code sequences representative of process 200 (shown in FIG. 4) or steps in process 200 (e.g., assessing one or more properties of the subsurface formation and/or the fracturing process in 228). Each code sequence may include one or more instructions, which when executed by a processor in a computer, implement the operations described for the corresponding code sequence. Generally speaking, a computer accessible storage medium may include any storage media accessible by a computer during use to provide instructions and/or data to the computer. For example, a computer accessible storage medium may include non-transitory storage media such as magnetic or optical media, e.g., disk (fixed or removable), tape, CD-ROM, DVD-ROM, CD-R, CD-RW, DVD-R, DVD-RW, or Blu-Ray. Storage media may further include volatile or non-volatile memory media such as RAM (e.g., synchronous dynamic RAM (SDRAM), Rambus DRAM (RDRAM), static RAM (SRAM), etc.), ROM, or Flash memory. The storage media may be physically included within the computer to which the storage media provides instructions/data. Alternatively, the storage media may be connected to the computer. For example, the storage media may be connected to the computer over a network or wireless link, such as network attached storage. The storage media may be connected through a peripheral interface such as the Universal Serial Bus (USB). Generally, computer accessible storage medium 510 may store data in a non-transitory manner, where non-transitory in this context may refer to not transmitting the instructions/data on a signal. For example, non-transitory storage may be volatile (and may lose the stored instructions/data in response to a power down) or non-volatile.

Further modifications and alternative embodiments of various aspects of the embodiments described in this disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described herein are to be taken as the presently preferred embodiments. Elements and materials may be substituted for those illustrated and described herein, parts and processes may be reversed, and certain features of the embodiments may be utilized independently, all as would be apparent to one skilled in the art after having the benefit of this description. Changes may be made in the elements described herein without departing from the spirit and scope of the following claims.

What is claimed is:

1. A method for assessing a diverter injected into a wellbore penetrating a subsurface formation, comprising:

forming a first fracture emanating from a first interval in a first wellbore in the subsurface formation, the first fracture being in direct fluid communication with a first fluid in the first wellbore in the subsurface formation;

recording a first pressure signal in a second wellbore using a pressure sensor in direct fluid communication with a second fluid in the second wellbore, the first pressure signal comprising a pressure change induced by a first applied pressure in the first fracture, and wherein recording the first pressure signal in the second wellbore comprises identifying a first pressure-induced poromechanic signal;

determining a first slope of a pressure versus time curve in the first pressure signal;

providing at least one diverter into the first interval in the first wellbore; and determining a second slope of the pressure versus time curve in the first pressure signal after providing the at least one diverter into the first wellbore to determine an effectiveness of the at least one diverter in inhibiting growth of the first fracture, wherein the at least one diverter is determined as being effective in inhibiting growth of the first fracture when the second slope in the first pressure signal is less than the first slope in the first pressure signal and the ratio of the second slope to the first slope is less than 1.

2. The method of claim 1, wherein the first slope in the first pressure signal and the second slope in the first pressure signal are slopes in the first pressure-induced poromechanic signal.

3. The method of claim 1, wherein determining the first slope in the first pressure signal comprises a slope due to the first applied pressure in the first fracture.

4. The method of claim 3, further comprising applying a second applied pressure in the first fracture after providing the at least one diverter in the first wellbore, wherein the second applied pressure is equal to or greater than the first applied pressure.

5. The method of claim 1, wherein providing the at least one diverter into the first interval in the first wellbore comprises injecting at least one diverter into the first wellbore.

6. The method of claim 1, wherein the first pressure signal is induced by fluid pressure from fracture fluid used to form the first fracture in the first wellbore.

7. The method of claim 1, wherein the second wellbore is adjacent the first wellbore in the formation.

8. The method of claim 1, wherein the subsurface formation comprises a hydrocarbon-bearing subsurface formation.

9. A system for assessing one or more geometric parameters of fractures in a subsurface formation, comprising:

a first wellbore in the subsurface formation;

a first fracture configured to be formed from a first interval in the first wellbore and in direct fluid communication with a first fluid in the first wellbore;

a second wellbore in the subsurface formation;

at least one diverter configured to be provided into the first interval in the first wellbore at a selected time;

a pressure sensor in direct fluid communication with a second fluid in the second wellbore; and a computer processor communicably coupled to the pressure sensor, wherein the computer processor is configured to perform operations comprising:

determining a first pressure signal from the pressure sensor while the first fracture is being formed, the first pressure signal being induced by a first applied pressure in the first fracture, the first pressure signal in the second wellbore comprising a first pressure-induced poromechanic signal;

determining a first slope of a pressure versus time curve in the first pressure signal; and determining a second slope of the pressure versus time curve in the first pressure signal after the at least one diverter is provided into the first wellbore at the selected time, wherein the second slope is used to determine an effectiveness of the at least one diverter in inhibiting growth of the first fracture, and wherein the at least one diverter is determined as being effective in inhibiting growth of the first fracture when the second slope in the first pressure signal is less than the first slope in the first pressure signal and the ratio of the second slope to the first slope is less than 1.

10. The system of claim 9, wherein the first slope in the first pressure signal and the second slope in the first pressure signal are slopes in the first pressure-induced poromechanic signal.

11. The system of claim 9, wherein the pressure sensor comprises a surface pressure gauge in direct fluid communication with the second fluid in the second wellbore.

12. The system of claim 9, wherein the subsurface formation comprises a hydrocarbon-bearing subsurface formation.

13. The system of claim 9, wherein the second wellbore comprises a casing.

14. The system of claim 9, wherein at least one of the first or second wellbores comprises a horizontal section.

15. A non-transient computer-readable medium including instructions that, when executed by one or more processors, causes the one or more processors to perform operations comprising:

identifying a first fracture that is formed and emanates from a first interval in a first wellbore in the subsurface formation, the first fracture being in direct fluid communication with a first fluid in the first wellbore in the subsurface formation;

assessing a first pressure signal in a second wellbore recorded by a pressure sensor in direct fluid communication with a second fluid in the second wellbore, wherein the first pressure signal assessed in the second wellbore includes a pressure change induced by a first applied pressure in the first fracture, and wherein assessing the first pressure signal in the second wellbore comprises identifying a first pressure-induced poromechanic signal in the first pressure signal;

determining a first slope of a pressure versus time curve in the first pressure signal; and determining a second slope of the pressure versus time curve in the first pressure signal after at least one diverter is provided into the first wellbore to determine an effectiveness of the at least one diverter in inhibiting growth of the first fracture, wherein the at least one diverter is determined as being effective in inhibiting growth of the first fracture when the second slope in the first pressure signal is less than the first slope in the first pressure signal and the ratio of the second slope to the first slope is less than 1.

16. A method for assessing a diverter injected into a wellbore penetrating a subsurface formation, comprising:

forming a first fracture emanating from a first interval in a first wellbore in the subsurface formation, the first fracture being in direct fluid communication with a first fluid in the first wellbore in the subsurface formation;

recording a first pressure signal in a second wellbore using a pressure sensor in direct fluid communication with a second fluid in the second wellbore, wherein the first pressure signal recorded in the second wellbore includes a pressure change induced by a first applied pressure provided in the first fracture, and wherein recording the first pressure signal in the second wellbore comprises identifying a first pressure-induced poromechanic signal in the first pressure signal;

determining a first pressure in a pressure versus time curve in the first pressure signal when the first applied pressure is provided in the first fracture;

providing at least one diverter into the first interval in the first wellbore; and determining a second pressure in the pressure versus time curve in the first pressure signal after providing the at least one diverter into the first wellbore to determine an effectiveness of the at least one diverter in inhibiting growth of the first fracture, wherein the at least one diverter is determined as being effective in inhibiting growth of the first fracture when the second pressure in the first pressure signal is less than the first pressure in the first pressure signal and the ratio of the second pressure to the first pressure is less than 1.

17. The method of claim 16, further comprising providing a second applied pressure in the first fracture after providing the at least one diverter in the first wellbore, wherein the second applied pressure is equal to or greater than the first applied pressure.

18. The method of claim 16, wherein the second wellbore comprises a casing.

19. The method of claim 16, wherein at least one of the first or second wellbores comprises a horizontal section.

20. The method of claim 16, wherein the second wellbore is adjacent the first wellbore in the formation.

* * * * *